US011572247B2

(12) United States Patent
Kawarada

(10) Patent No.: US 11,572,247 B2
(45) Date of Patent: Feb. 7, 2023

(54) SHEET MATERIAL CUTTING DEVICE, COATING DEVICE, AND PRINTING APPARATUS

(71) Applicant: Masaya Kawarada, Kanagawa (JP)

(72) Inventor: Masaya Kawarada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 152 days.

(21) Appl. No.: 17/111,400

(22) Filed: Dec. 3, 2020

(65) Prior Publication Data

US 2021/0188588 A1 Jun. 24, 2021

(30) Foreign Application Priority Data

Dec. 18, 2019 (JP) ..... JP2019-228407

(51) Int. Cl.

| | |
|---|---|
| ***B26D 7/06*** | (2006.01) |
| ***B65H 35/00*** | (2006.01) |
| ***B41J 11/70*** | (2006.01) |
| *B41J 11/00* | (2006.01) |

(52) U.S. Cl.

CPC ..... *B65H 35/0086* (2013.01); *B41J 11/70* (2013.01); *B41J 11/0024* (2021.01); *B41J 11/00216* (2021.01)

(58) Field of Classification Search

CPC .. B26D 1/38; B26D 7/06; B41F 13/60; B65H 35/04; B65H 35/06; B65H 35/0086; B41J 11/70

USPC ..... 270/5.02, 58.07; 101/224, 226; 118/42

See application file for complete search history.

(56) References Cited

U.S. PATENT DOCUMENTS

| | | | | |
|---|---|---|---|---|
| 4,488,466 | A * | 12/1984 | Jones | B65H 35/06 225/105 |
| 4,742,742 | A * | 5/1988 | Yokoe | B26D 7/32 83/101 |
| 4,770,358 | A * | 9/1988 | Suzuki | B65H 19/28 242/906 |
| 4,867,064 | A * | 9/1989 | Hara | B41F 35/06 101/226 |
| 8,398,065 | B2 * | 3/2013 | Obuchi | B26F 1/14 270/58.07 |
| 8,469,347 | B2 * | 6/2013 | Hata | B42C 9/0025 399/407 |
| 10,016,989 | B1 * | 7/2018 | Sugimoto | B41J 11/70 |
| 2008/0112746 | A1 * | 5/2008 | Yamamoto | G03G 15/6523 399/385 |
| 2017/0368849 | A1 * | 12/2017 | Masunaga | B41J 11/005 |

FOREIGN PATENT DOCUMENTS

| | | |
|---|---|---|
| JP | 2008-119935 | 5/2008 |

* cited by examiner

*Primary Examiner* — Leslie A Nicholson, III

(74) *Attorney, Agent, or Firm* — Duft & Bornsen, PC

(57) ABSTRACT

A sheet material cutting device includes a cutting blade and a guard member. The cutting blade is displaceably disposed and cuts a web-shaped sheet material. The guard member faces the sheet material and has a slit through which the cutting blade passes when the cutting blade is displaced to a cutting position.

10 Claims, 12 Drawing Sheets

SHEET MATERIAL CUTTING DEVICE, COATING DEVICE, AND PRINTING APPARATUS

CROSS-REFERENCE TO RELATED APPLICATION

This patent application is based on and claims priority pursuant to 35 U.S.C. § 119(a) to Japanese Patent Application No. 2019-228407, filed on Dec. 18, 2019, in the Japan Patent Office, the entire disclosure of which is incorporated by reference herein.

BACKGROUND

Technical Field

Aspects of the present disclosure relate to a sheet material cutting device, a coating device, and a printing apparatus.

Related Art

Generally, there is a printing apparatus including a plurality of cutting units that are arranged at a plurality of places along a conveyance path of a recording medium and cut the recording medium based on a conveyance state of the recording medium.

SUMMARY

In an aspect of the present disclosure, there is provided a sheet material cutting device that includes a cutting blade and a guard member. The cutting blade is displaceably disposed and cuts a web-shaped sheet material. The guard member faces the sheet material and has a slit through which the cutting blade passes when the cutting blade is displaced to a cutting position.

In another aspect of the present disclosure, there is provided a coating device that includes a coater to coat a coating liquid on the sheet material and the sheet material cutting device.

In still another aspect of the present disclosure, there is provided a printing apparatus that includes the coating device.

In still yet another aspect of the present disclosure, there is provided a printing apparatus that includes the sheet material cutting device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
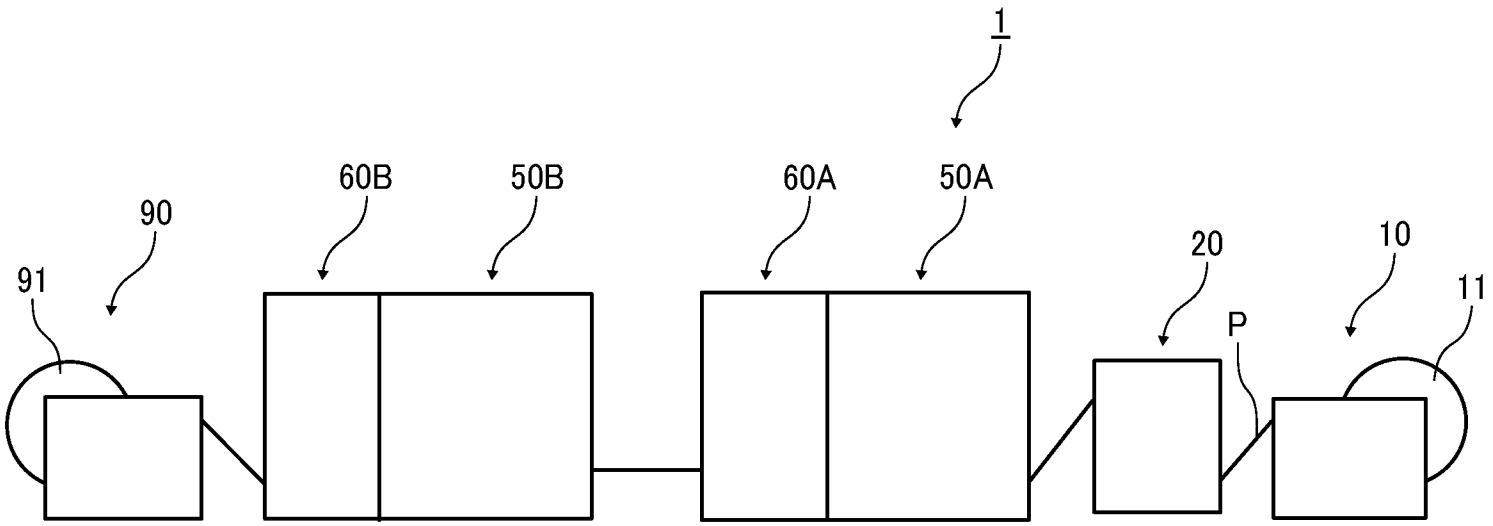
FIG. 1 is a schematic illustration of a printing apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

First, a printing apparatus according to a first embodiment of the present disclosure is described with reference to FIG. 1. FIG. 1 is a schematic illustration of the printing apparatus according to the first embodiment of the present disclosure.

The printing apparatus 1 includes an unwinding device 10, a coating device 20, a first discharge device 50A, a first drying device 60A, a second discharge device 50B, a second drying device 60B, and a winding device 90.

The unwinding device 10 is a carry-in unit to unwind and carry in a sheet material P, which is a web such as continuous form sheet, from an original winding roller 11. The coating device 20 is a pre-treatment unit to apply treatment liquid as coating liquid onto both faces of the sheet material P conveyed from the unwinding device 10.

The first discharge device 50A is a printing unit including a first discharger to discharge and print liquid containing colorant onto one face of the sheet material P, both faces of which are coated with the treatment liquid by the coating device 20. The first drying device 60A is a drier to heat and dry the sheet material P onto which the liquid is discharged by the first discharge device 50A.

The second discharge device 50B is a printing unit including a second discharger to discharge and print liquid containing colorant onto the other face of the sheet material P heated in the first drying device 60A. The second drying device 60B is a drier to heat and dry the sheet material P onto which the liquid is discharged by the second discharge device 50B.

The winding device 90 is a carry-out unit to wind the sheet material P, which has been dried by passing through the second drying device 60B, onto the winding roller 91.

Figure 2:
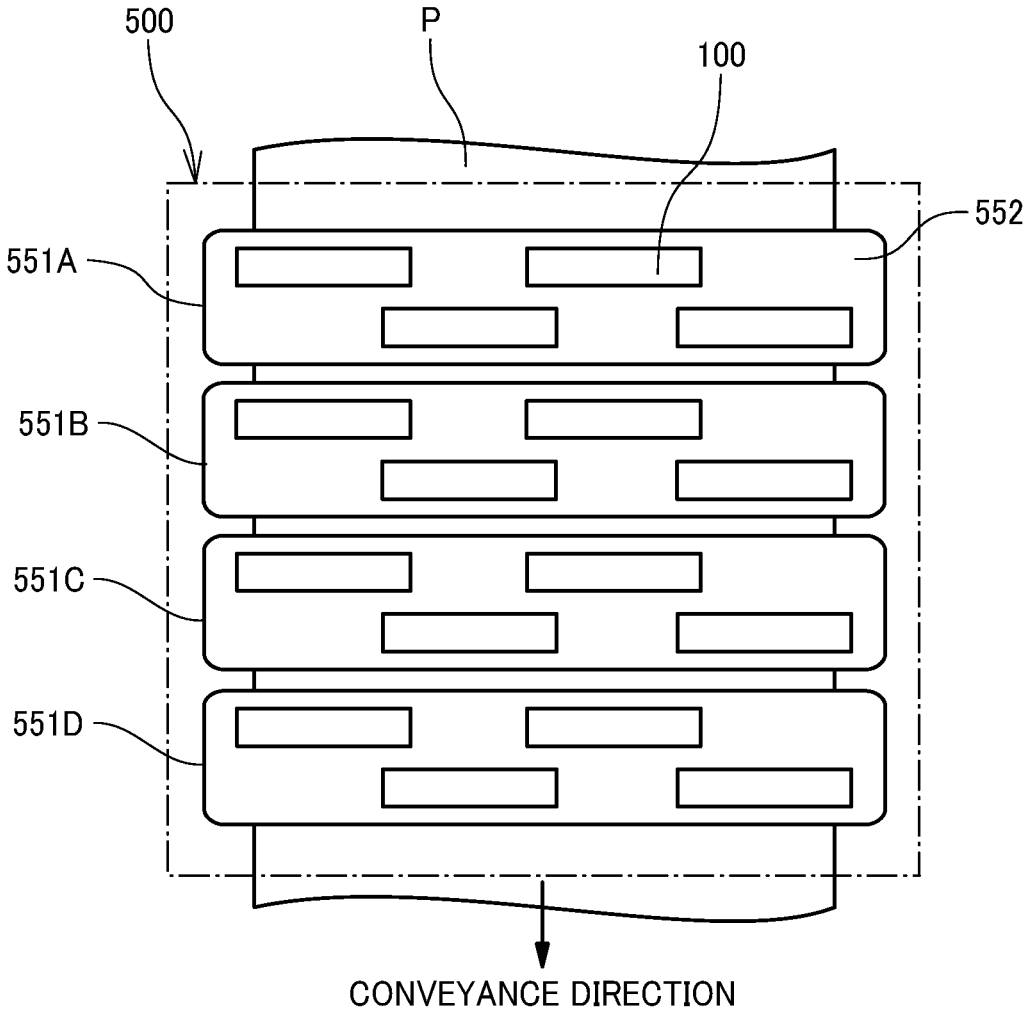
FIG. 2 is an illustration of an example of a discharger included in a first discharge device and a second discharge device.

Next, an example of the first discharge device 50A and the second discharge device 50B is described with reference to FIG. 2. FIG. 2 is an illustration of an example of the discharger of each of the above-described discharge devices.

Each of the first discharge device 50A and the second discharge device 50B includes a discharger 500. The discharger 500 of the first discharge device 50A is referred to as a first discharger, and the discharger 500 of the second discharge device 50B is referred to as a second discharger.

In the discharger 500, full-line type head arrays 551A, 551B, 551C, and 551D for four colors (hereinafter referred to as "head array 551" when colors are not distinguished), are arranged from the upstream side in a conveyance direction of a sheet material P.

Each head array 551 is a liquid discharger and discharges liquid of black (K), cyan (C), magenta (M), or yellow (Y) to the sheet material P to be conveyed. Note that the type and number of color are not limited to the above-described four colors.

The head array 551 includes, for example, liquid discharge heads (which are also simply referred to as "heads") 100 arranged in a zigzag manner on a base member 552. However, the arrangement of heads is not limited to such arrangement.

Figure 3:
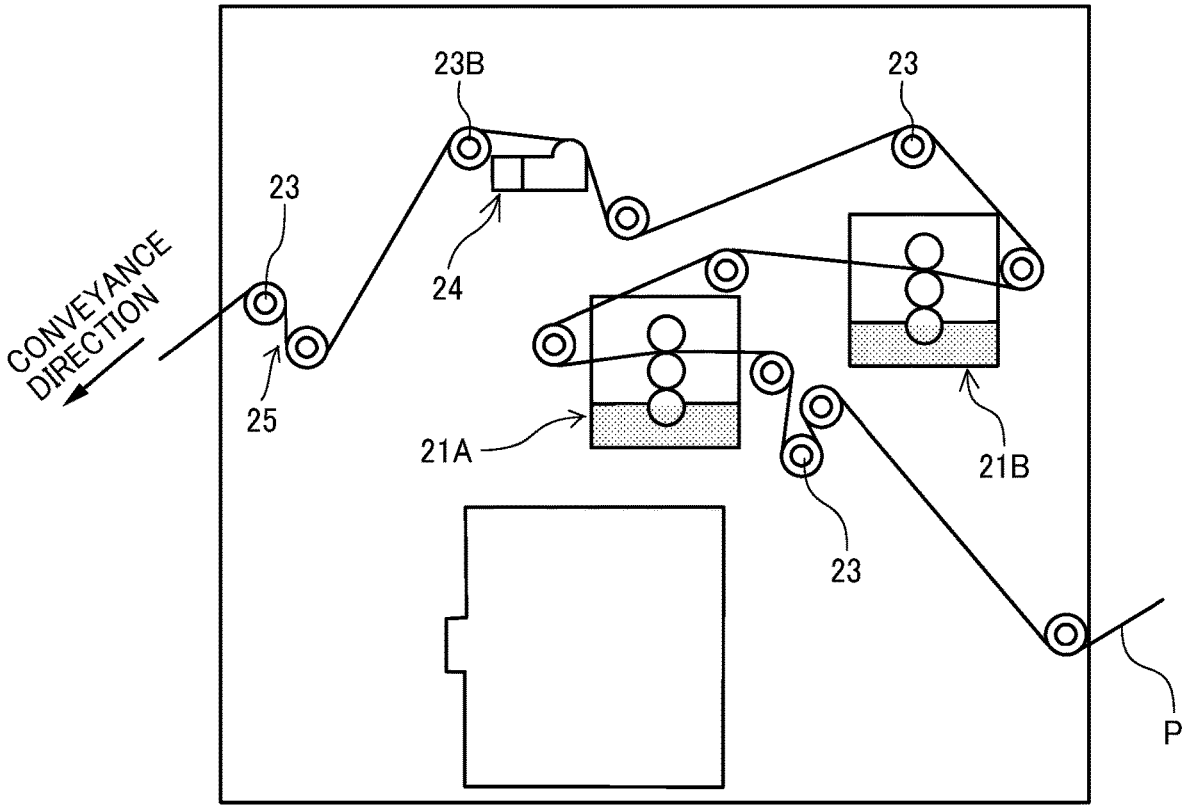
FIG. 3 is an illustration of an example of a coating device.

Next, an example of the coating device is described with reference to FIGS. 3 and 4. FIG. 3 is an illustration of the coating device, and FIG. 4 is an illustration of a coater of the coating device.

The coating device 20 as an example of the coating device includes a first coater 21A, a second coater 21B, a plurality of guide rollers 23, a sheet material cutting device 400, and so forth. Furthermore, the coating device 20 has an S-shaped conveyance path 25 immediately upstream from an outlet in the conveyance direction of the sheet material P to enhance the running stability of the sheet material P.

The first coater 21A is a treatment liquid applicator to apply treatment liquid 201 as coating liquid onto one face (front face) of the sheet material P being conveyed. The second coater 21B is a treatment liquid applicator to apply the treatment liquid 201 onto the other face (back face) of the sheet material P.

Figure 4:
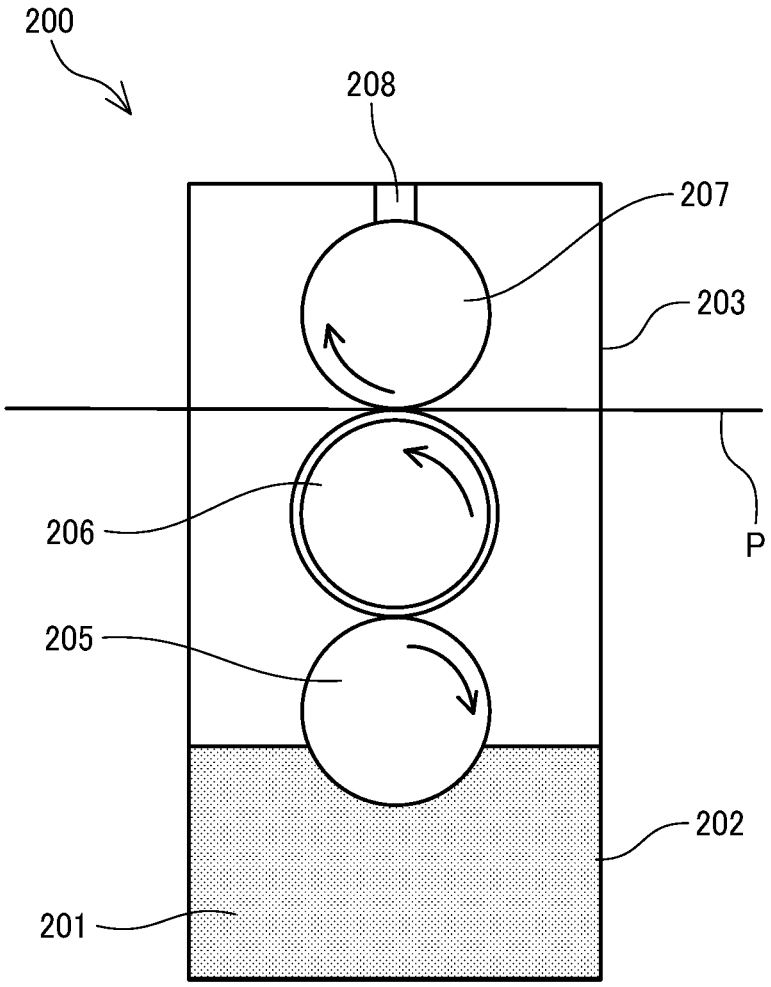
FIG. 4 is an illustration of a coater of the coating device.

Each of the first coater 21A and the second coater 21B are configured with a coater 200 illustrated in FIG. 4.

The coater 200 includes a treatment liquid container 202 to contain the treatment liquid 201. The treatment liquid container 202 may be integrated with a case member 203 that is a housing of the coater 200.

The coater 200 includes a transfer roller 205 and a coating roller 206. The transfer roller 205 is accommodated in the treatment liquid container 202 to scoop the treatment liquid 201. The coating roller 206 applies the treatment liquid 201 to the sheet material P after the treatment liquid 201 is transferred onto the coating roller 206 by the transfer roller 205. The transfer roller 205 is rotated at a speed slightly slower than the conveyance speed of the sheet material P.

Further, the coater 200 includes a pressure roller 207 facing the coating roller 206 to press the sheet material P and a pressure adjusting device 208 to adjust the pressing pressure of the pressure roller 207.

In the coater 200, the transfer roller 205 transfers the treatment liquid 201 onto the surface of the coating roller 206 in the shape of a thin film.

Then, the coating roller 206 is pressed against the rotating pressure roller 207 and the coating roller 206 is rotated. At this time, the coater 200 conveys the sheet material P into a gap between the coating roller 206 and the pressure roller 207 to apply the treatment liquid 201 onto the surface of the sheet material P.

The pressure adjusting device 208 controls the nip pressure arising when the treatment liquid 201 is applied to the sheet material P (i.e., the pressure acting at a position where the coating roller 206 and the pressure roller 207 are in contact with each other). The applied amount (application amount, film thickness, liquid amount, adhesion amount, dry adhesion amount, etc.) of the treatment liquid 201 can be adjusted by changing the nip pressure using the pressure adjusting device 208.

Further, the applied amount of the treatment liquid 201 can be also controlled by changing the rotational speeds of the coating roller 206 and the pressure roller 207.

A liquid of which the agglutination reaction with ink does not change significantly in either a wet state or a dry state, is used as the treatment liquid 201. For example, a pre-coating liquid as described in JP-2019-019315-A may be cited.

Figure 5:
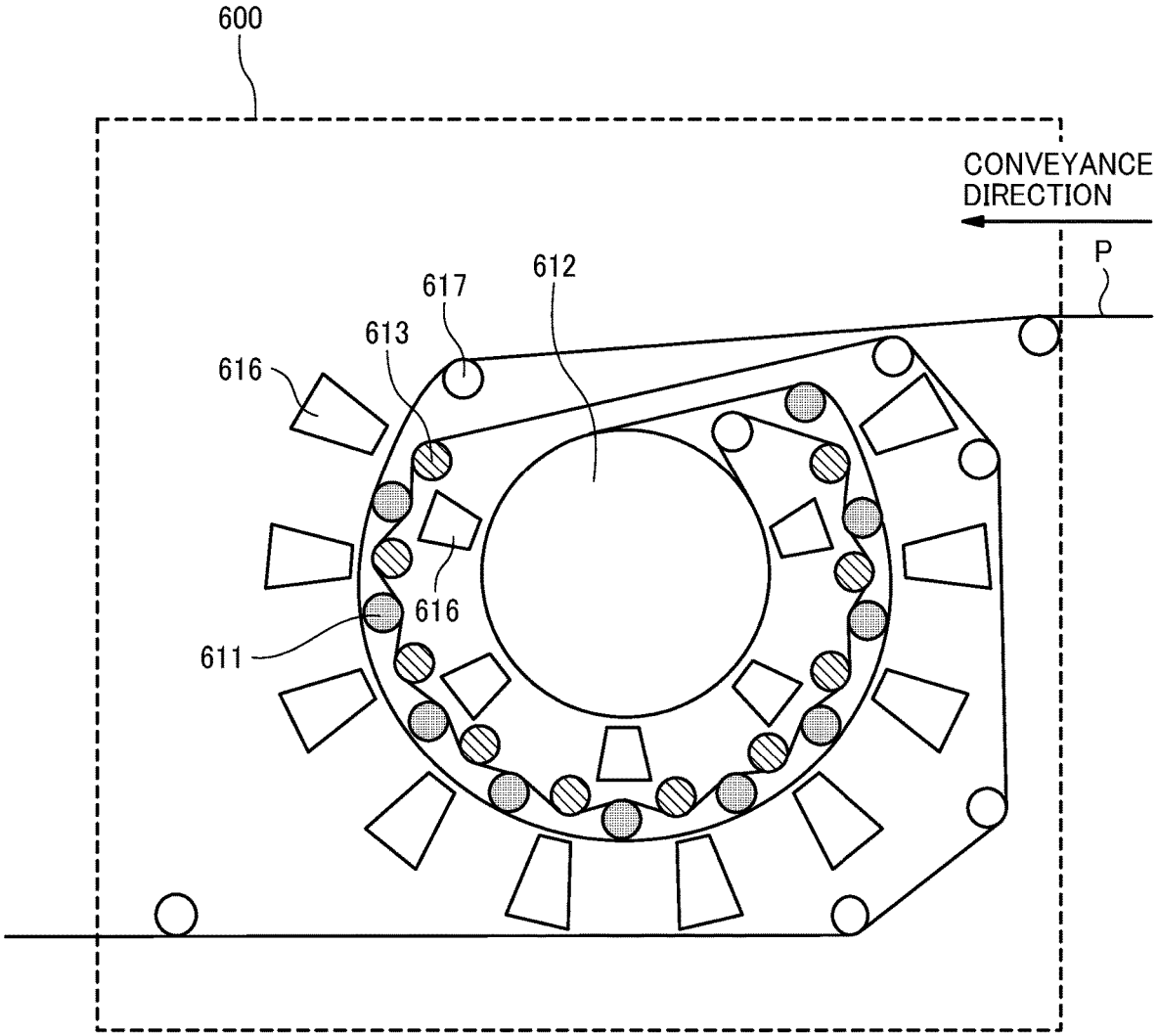
FIG. 5 is an illustration of an example of a dryer included in a first drying device and a second drying device.

Next, an example of the drier constituting each of the first drying device and the second drying device is described with reference to FIG. 5. FIG. 5 is an illustration of the drier of each of the above-described drying devices. Note that, in FIG. 5, the rotating bodies having the same function are indicated with the same hatch or dot pattern, and the reference numerals are omitted.

Each of the first drying device 60A and the second drying device 60B includes a drier 600. The drier 600 of the first drying device 60A is referred to as a first drier, and the drier 600 of the second drying device 60B is referred to as a second drier.

The drier 600 includes a plurality of heating rollers 611 and a heating drum 612 to heat a sheet material P in contact with the sheet material P. Further, the drier 600 includes a plurality of guide rollers 613 to guide the sheet material P so that the sheet material P contacts necessary heating rollers 611 among the plurality of heating rollers 611.

A heating conveyance path (or a conveyance path) for heating the sheet material P is configured by the plurality of heating rollers 611, the heating drum 612, and the plurality of guide rollers 613. The sheet material P is conveyed while contacting the outer peripheral side of the plurality of heating rollers 611 arranged in an arc shape on the upstream side of the heating drum 612 in the conveyance direction of the sheet material P. Then, the sheet material P passes through the heating drum 612, and is conveyed by the guide roller 613 while contacting the inner peripheral side of the plurality of heating rollers 611.

In other words, in the present embodiment, the sheet material P is brought into contact with the heating roller 611 from different directions and heated by the heating rollers 611.

Further, in the drier 600, a plurality of non-contact heating units 616 that heats the sheet material P from a liquid applied face side are arranged on the outer peripheral side of the arrangement of the plurality of heating rollers 611, and a plurality of non-contact heating units 616 are also arranged around the heating drum 612. The non-contact heating unit 616 can be configured with, for example, an air blowout unit or an infrared (IR) heater. Note that, in the present embodiment, "liquid applied face" refers to a face on which liquid has been applied by discharge of the discharger 500 of the first discharge device 50A or the second discharge device 50B.

Further, the drier 600 includes a plurality of guide rollers 617 that guides the sheet material P to carry the sheet P into and out the drier 600.

As the flow of a drying process in the drier 600 thus configured, the non-contact heating units 616, for example, blow air to the liquid applied face to heat the liquid applied face, while the opposite face of the liquid applied face of the sheet material P is brought into contact with and heated by the heating rollers 611.

Then, the non-contact heating units 616, for example, blow air to the liquid applied face to heat the liquid applied face, while the opposite face of the liquid applied face of the sheet material P is brought into contact with and heated by the heating drum 612, which is disposed inside the arrangement of the plurality of heating rollers 611.

Thereafter, while the guide rollers 613 are brought into contact with the liquid applied face of the sheet material P, the heating rollers 611 contact the face opposite to the liquid applied face of the sheet material P and heat the sheet material P to dry the liquid applied to the sheet material P.

At this time, the treatment liquid 201 applied to both faces of the sheet material P by the coating device 20 is also dried, and the treatment liquid 201 is in a dry state.

As above described, the printing apparatus 1 includes the coating device 20 including the first coater 21A and the second coater 21B, each of which is configured with the coater 200 that applies the coating liquid (treatment liquid 201) on both faces of the sheet material P.

The printing apparatus 1 further includes the first discharge device 50A and the first drying device 60A. The first discharge device 50A receives the sheet material P, of which the treatment liquid 201 is applied on both faces by the coating device 20, as it is and discharges liquid to one face of the sheet material P. The first drying device 60A dries the sheet material P applied with the liquid in the first discharge device 50A.

Further, the printing apparatus 1 includes the second discharge device 50B and the second drying device 60B. The second discharge device 50B discharges liquid to the other face of the sheet material P having passed through the first drying device 60A. The second drying device 60B dries the sheet material P applied with the liquid which is discharged in the second discharge device 50B.

Thus, in the printing apparatus 1, the coating liquid is applied to both faces of the sheet material P, the liquid is discharged to the sheet material P conveyed to the first discharge device 50A, which is the first discharger, without being heated, and then printing and drying are performed. As a result, the coating liquid applied to the sheet material P and the printing liquid applied in the first discharge device 50 are dried. Thereafter, the liquid is discharged in the second discharge device 50B, which is the second discharger, onto the other face of the sheet material P, and then printing and drying are performed.

Figure 6:
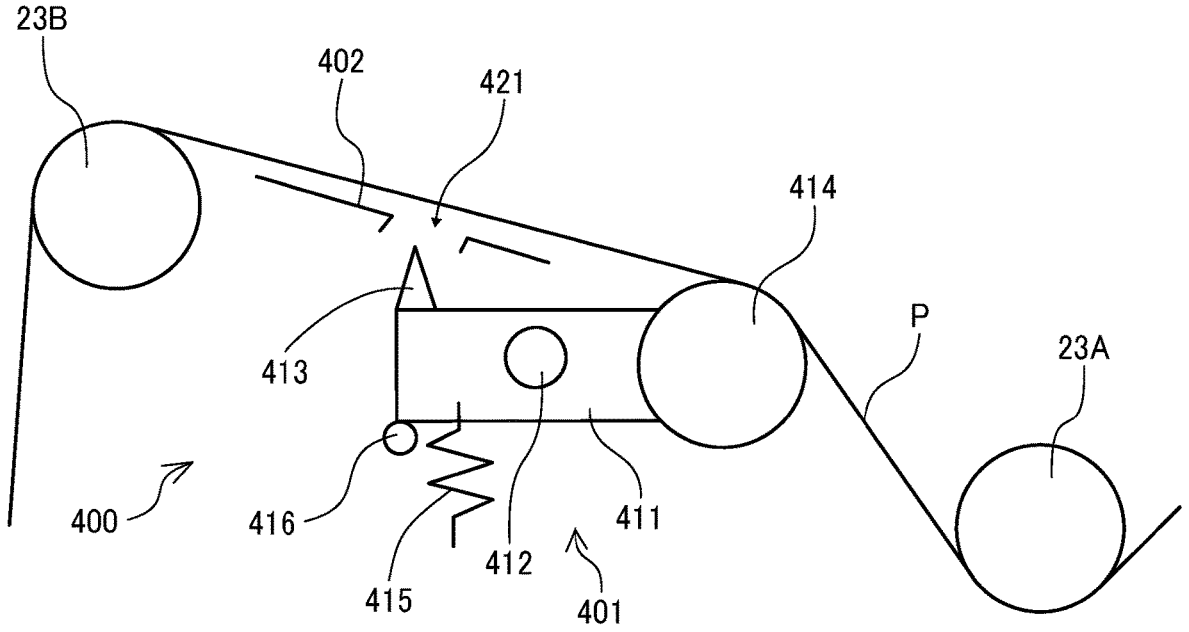
FIG. 6 is a side view of a sheet material cutting device according to the first embodiment of the present disclosure.
Figure 7:
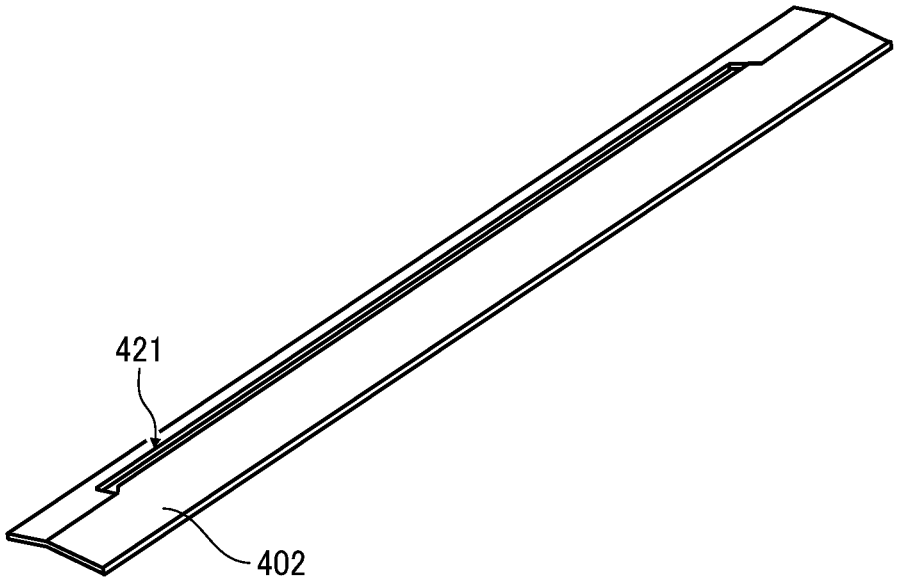
FIG. 7 is a perspective view of a guard member of the sheet material cutting device according to the first embodiment of the present disclosure.

Next, the sheet material cutting device according to the first embodiment of the present disclosure is described with reference to FIGS. 6 and 7. FIG. 6 is a side view of the sheet material cutting device and FIG. 7 is a perspective view of a guard member of the sheet cutting device according to the first embodiment of the present disclosure.

The sheet material cutting device 400 according to the first embodiment includes a cutter mechanism 401 disposed between two guide rollers 23 (23A and 23B).

The cutter mechanism 401 includes an arm member 411. The arm member 411 is rotatably supported by a shaft 412. A cutting blade 413 for cutting the sheet material P is attached to one end of the arm member 411. Thus, the cutting blade 413 is disposed so that the cutting blade 413 can be displaced between a cutting position of the sheet material P and an evacuation position.

A contact member 414 in contact with the sheet material P is attached to the other end of the arm member 411. The contact member 414 can be a rotating body rotated by conveyance of the sheet material P or a member that simply guides a sheet material P.

Further, the cutter mechanism 401 includes a biasing member 415 to rotate and bias the arm member 411 in a direction in which the contact member 414 comes into contact with the sheet material P, and a stopper 416 to define the initial position of the arm member 411. In the initial position, the arm member 411 is in contact with the stopper 416. The position at which the cutting blade 413 is placed when the arm member 411 is in the initial position is the evacuation position.

The sheet material cutting device 400 includes a guard member 402 disposed between the sheet material P and the cutter mechanism 401 to face the sheet material P. The guard member 402 has a slit 421 through which the cutting blade 413 can pass when the cutting blade 413 is displaced to the cutting position for cutting the sheet material P.

Figure 8A:
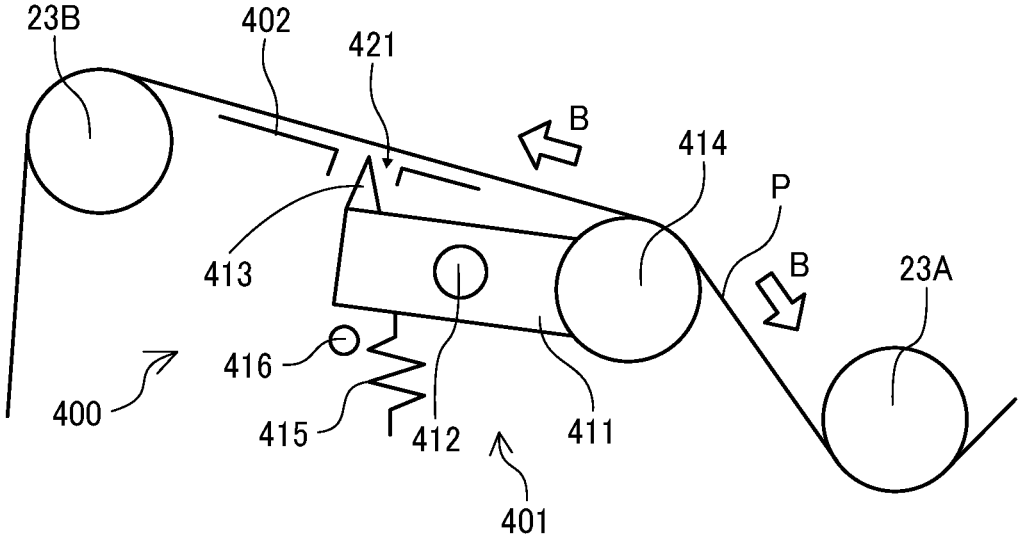
FIGS. 8A, 8B, and 8C are side views of a cutting operation of the sheet material cutting device according to the first embodiment of the present disclosure.
Figure 8B:
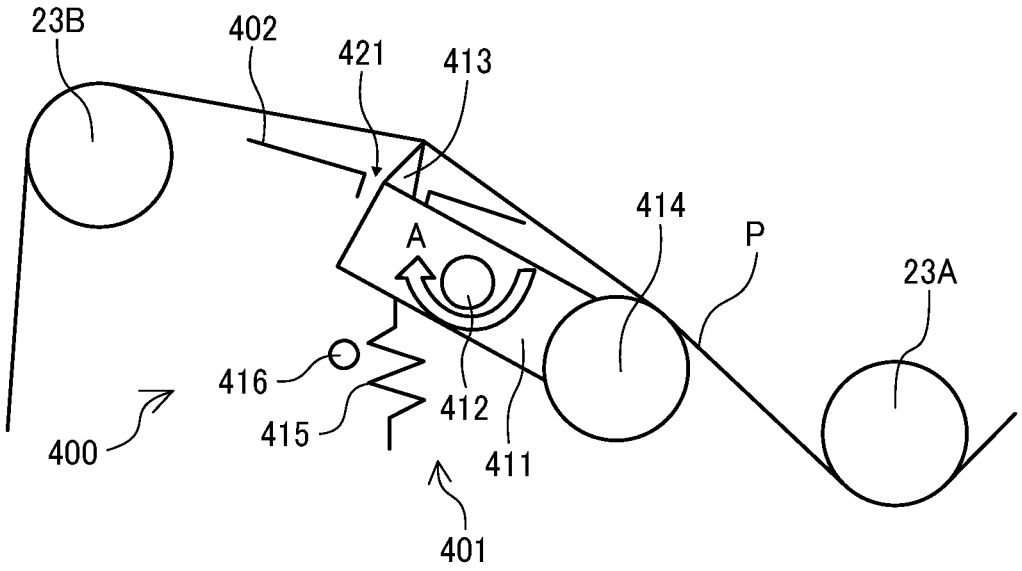
Figure 8C:
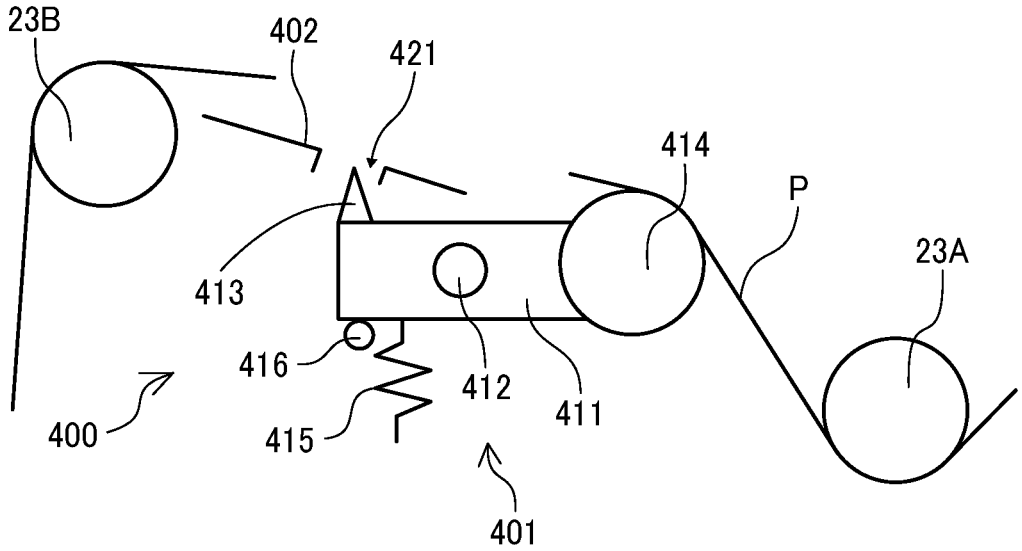

Next, a cutting operation according to the present embodiment is described with reference to FIGS. 8A to 8C. FIGS. 8A to 8C are side views of the cutting operation of the sheet material cutting device according to the present embodiment.

When the sheet material P is being conveyed with the required tension, as illustrated in FIG. 6 or 8A, the contact member 414 at the other end of the arm member 411 is in contact with the sheet material P, and the cutting blade 413 at one end of the arm member 411 does not protrude from the slit 421 of the guard member 402 toward the sheet material P.

The tension of the sheet material P may be higher than the normal state due to abnormalities such as a defect of the feeding-out or unwinding amount of the sheet material P and stopping of the conveying motor. As the tension of the sheet material P increases, the sheet material P is pulled in the direction of arrow B in FIG. 8A.

As the sheet material P is pulled in the direction of arrow B, as illustrated in FIG. 8B, the contact member 414 of the arm member 411 is pressed by the sheet material P, and the arm member 411 rotates in the direction of arrow A against the biasing force of the biasing member 415.

As a result, the cutting blade 413 passes through the slit 421 of the guard member 402, contacts the sheet material P, and bites into the sheet material P. Thereafter, the sheet material P is cut by the cutting blade 413, as illustrated in FIG. 8C.

When the sheet material P is cut, the force to push the contact member 414 is eliminated. Accordingly, the arm member 411 is rotated by the biasing force of the biasing member 415 in the direction opposite to the direction of arrow A to return to the initial position. As a result, the cutting blade 413 returns to the position at which the cutting blade 413 does not protrude from the slit 421 of the guard member 402.

Next, the state of the sheet material cutting device for loading the sheet material is described with reference to FIG. 6.

When the sheet material P is not loaded, the arm member 411 is biased to the biasing member 415 by the biasing force, and one end portion of the arm member 411 is in contact with the stopper 416. At this time, the cutting blade 413 is in a position at which the cutting blade 413 does not protrude from the slit 421 of the guard member 402.

Such a configuration prevents the sheet material P from interfering with the cutting blade 413 when the sheet material P is loaded into the coating device 20, thereby enhancing the loadability of the sheet material P.

Figure 9:
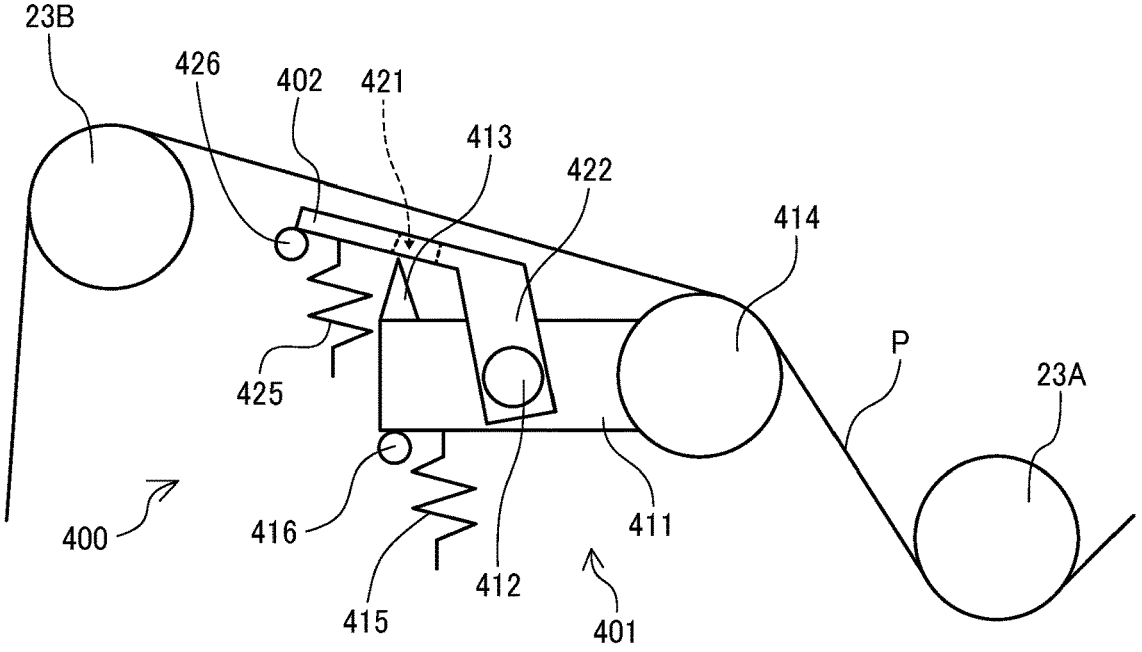
FIG. 9 is a side view of a sheet material cutting device according to a second embodiment of the present disclosure.
Figure 10:
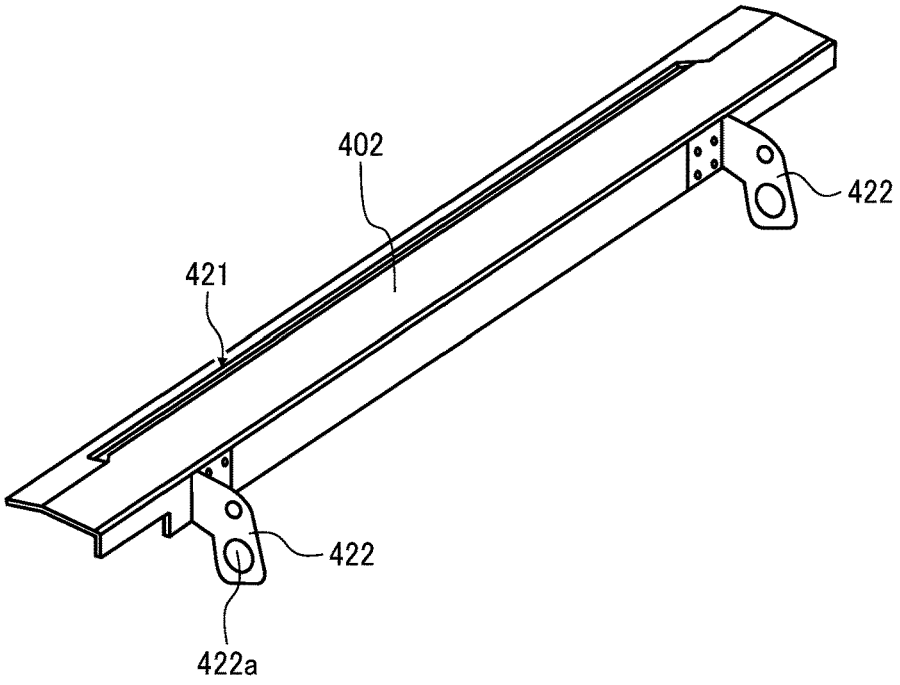
FIG. 10 is a perspective view of a guard member of the sheet material cutting device according to the second embodiment of the present disclosure.

Next, a sheet material cutting device according to a second embodiment of the present disclosure is described with reference to FIGS. 9 and 10. FIG. 9 is a side view of the sheet material cutting device according to the second embodiment and FIG. 10 is a perspective view of a guard member of the sheet cutting device according to the second embodiment of the present disclosure.

In the present embodiment, the guard member 402 in the first embodiment has support portions 422. Each support portion 422 has a through-hole 422*a*, and a shaft 412 of an arm member 411 is inserted through the through-hole 422*a*. As a result, the guard member 402 is rotatably supported on the shaft 412 of the arm member 411.

Further, the sheet material cutting device includes a biasing member 425 and a stopper 426. The biasing member 425 that rotates and biases the guard member 402 is disposed on the opposite side of the support portions 422 of the guard member 402. The stopper 426 defines an initial position of the guard member 402.

Next, a cutting operation according to the present embodiment is described with reference to FIG. 11. FIG. 11 is a side view of the cutting operation of the sheet material cutting device according to the present embodiment.

When the sheet material P is in a state of being conveyed at a required tension, as illustrated in FIG. 9, the contact member 414 at the other end of the arm member 411 contacts the sheet material P, and the cutting blade 413 at one end of the arm member 411 does not protrude from the slit 421 of the guard member 402 toward the sheet material P.

Figure 11A:
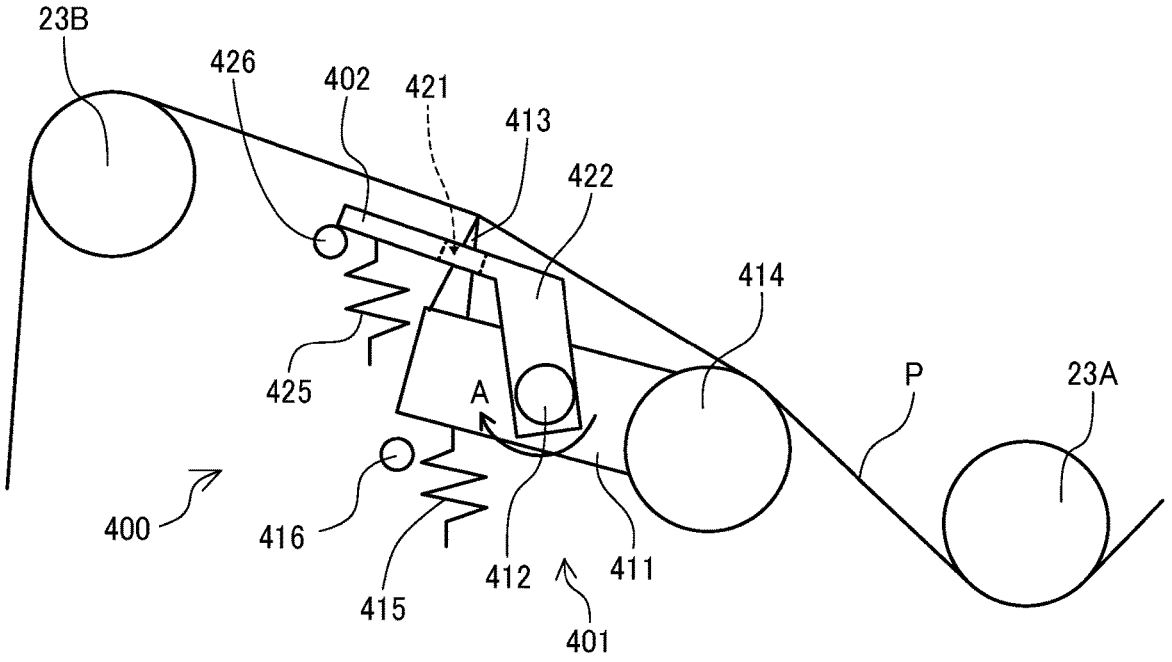
FIGS. 11A and 11B are side views of a cutting operation of the sheet material cutting device according to the second embodiment of the present disclosure.

When the tension of the sheet material P becomes larger than the normal state, as illustrated in FIG. 11A, the contact member 414 of the arm member 411 is pressed by the sheet material P, and the arm member 411 rotates in the direction of arrow A against the biasing force of the biasing member 415.

Figure 11B:
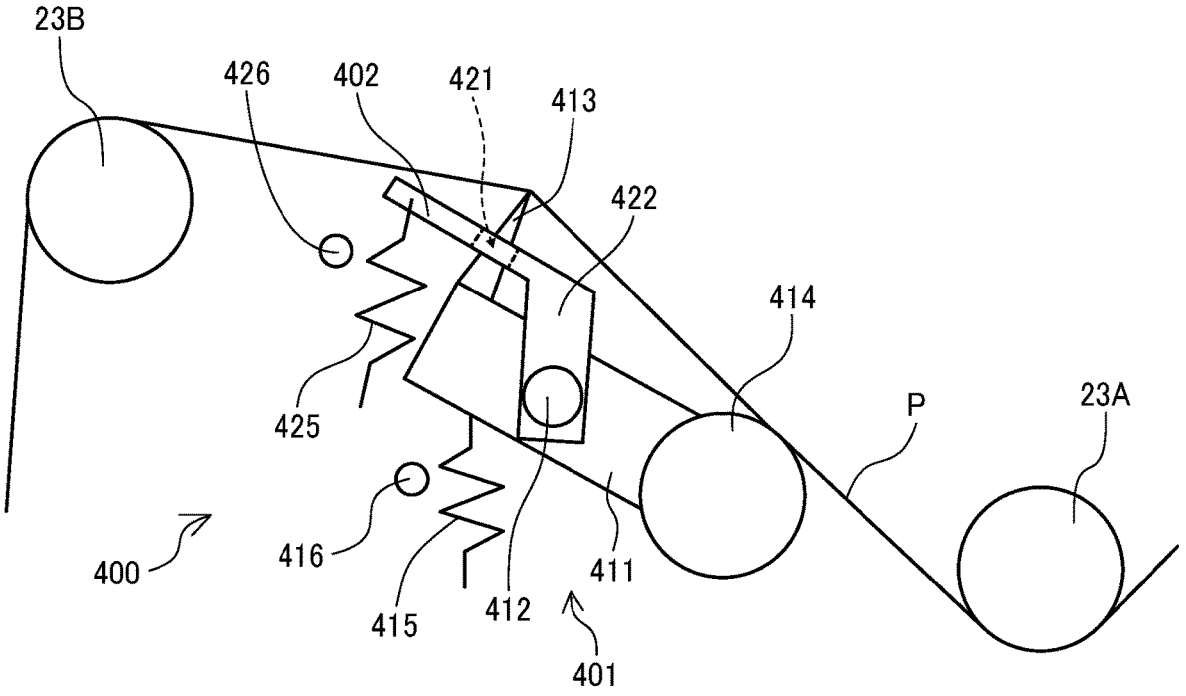

As a result, a part of the cutting blade 413 enters and passes through the slit 421 of the guard member 402. When the arm member 411 is rotated and displaced from the above-described state to a predetermined position in the direction of arrow A, as illustrated in FIG. 11B, the guard member 402 is pushed upward by the arm member 411, and the guard member 402 and the cutting blade 413 are rotated and displaced together. Note that the "predetermined position" is the position at which the arm member 411 and the guard member 402 start to rotate together.

Then, the cutting blade 413 rotates in the state of protruding from the slit 421 of the guard member 402, and contacts and bites into the sheet material P. Thus, the sheet material P is cut by the cutting blade 413.

After the sheet material P is cut, the cutting blade 413 of the arm member 411 returns to the initial position (evacuation position) of FIG. 9 by a restoring force of the biasing member 415, and the guard member 402 returns to the initial position (evacuation position) of FIG. 9 by a restoring force of the biasing member 425.

Figure 12:
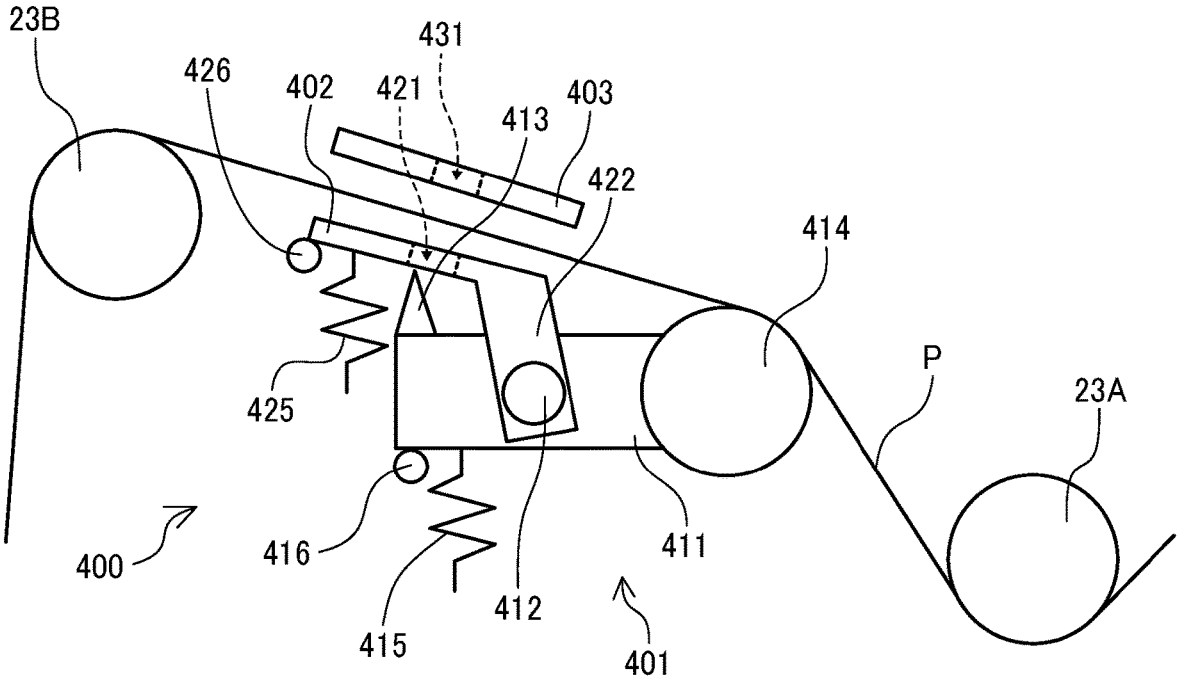
FIG. 12 is a side view of a sheet material cutting device according to a third embodiment of the present disclosure.
Figure 13:
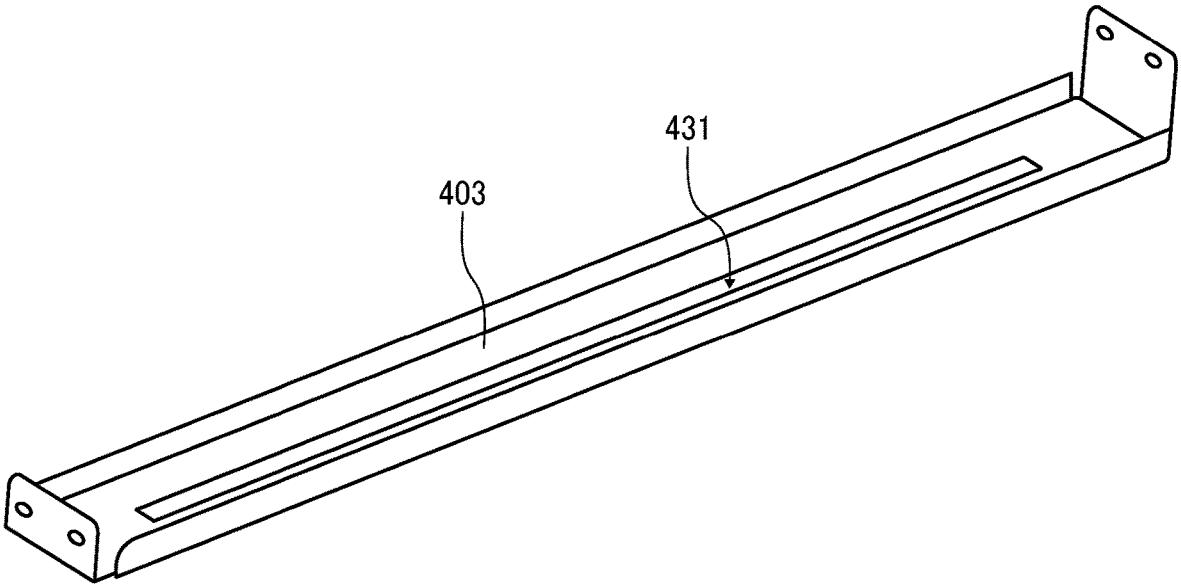
FIG. 13 is a perspective view of an opposing member of the sheet material cutting device according to the third embodiment of the present disclosure.

Next, a sheet material cutting device according to a third embodiment of the present disclosure is described with reference to FIGS. 12 and 13. FIG. 12 is a side view of the sheet material cutting device according to the third embodiment and FIG. 13 is a perspective view of an opposing member of the sheet material cutting device according to the third embodiment.

In the present embodiment, in the configuration of the second embodiment, an opposing member 403 is disposed opposite the guard member 402 across the sheet material P. The opposing member 403 has a slit 431 through which the cutting blade 413 can enter. The width of the slit 431 (the width of the slit 431 in the conveyance direction of the sheet material P) may be either a width through which a part of the cutting blade 413 does not pass or a width through which a part of the cutting blade 413 passes.

Figure 14A:
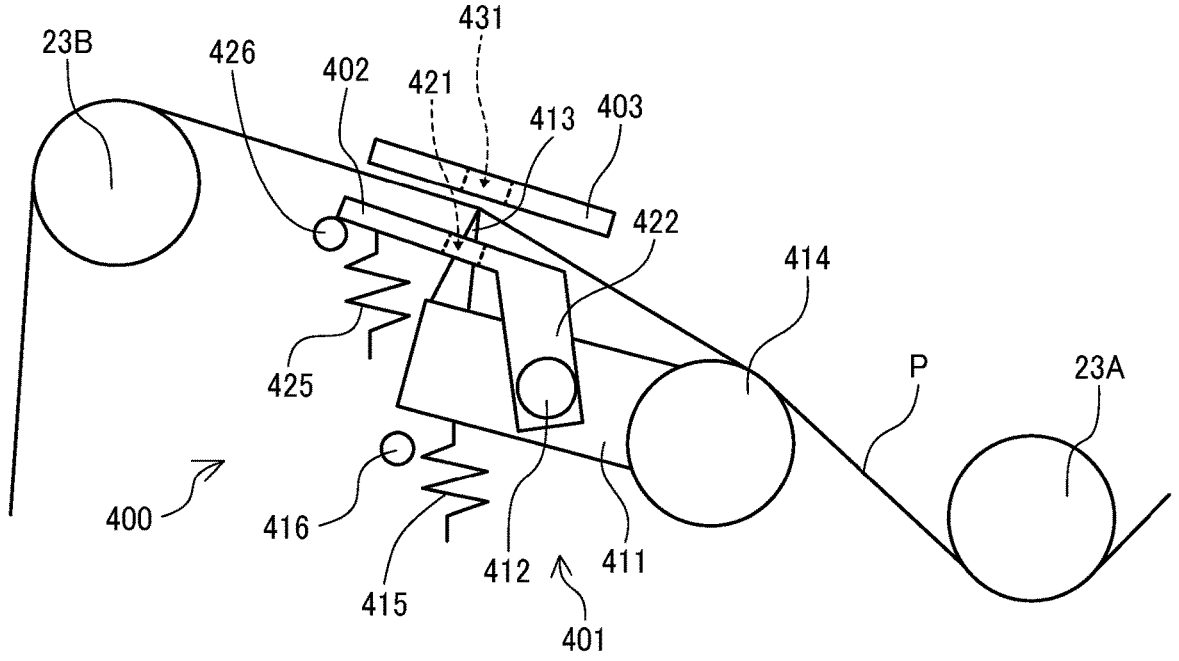
FIGS. 14A and 14B are side views of a cutting operation of the sheet material cutting device according to the third embodiment of the present disclosure.
Figure 14B:
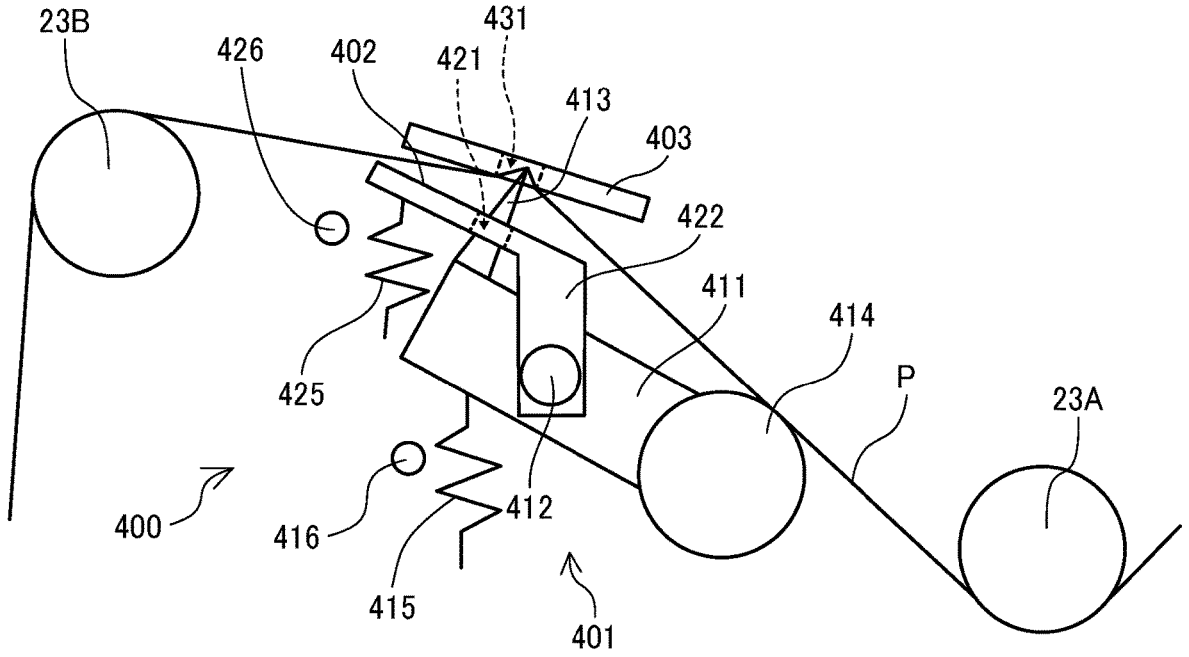

Next, a cutting operation according to the present embodiment is described with reference to FIGS. 14A and 14B. FIGS. 14A and 14B are side views of the cutting operation of the sheet material cutting device according to the present embodiment.

When the sheet material P is in a state of being conveyed at a required tension, as illustrated in FIG. 12, the contact member 414 at the other end of the arm member 411 contacts the sheet material P, and the cutting blade 413 at one end of the arm member 411 does not protrude from the slit 421 of the guard member 402 toward the sheet material P. Here, when the tension of the sheet material P is larger than the normal state, as illustrated in FIG. 14A, the contact member 414 of the arm member 411 is pressed by the sheet material P, and the arm member 411 rotates in the direction of arrow A against the biasing force of the biasing member 415.

As a result, a part of the cutting blade 413 enters and passes through the slit 421 of the guard member 402. When the arm member 411 is rotated and displaced from the above-described state to a predetermined position in the direction of arrow A, as illustrated in FIG. 14B, the guard member 402 is pushed up by the arm member 411, and the guard member 402 and the cutting blade 413 are rotated and displaced together.

The cutting blade 413 rotates in a state of protruding from the slit 421 of the guard member 402, and contacts and bites into the sheet material P. Thus, a part of the cutting blade 413 enters the slit 431 of the opposing member 403, and the sheet material P is cut by the cutting blade 413.

After the sheet material P is cut, the cutting blade 413 of the arm member 411 returns to the initial position (evacuation position) of FIG. 12 by a restoring force of the biasing member 415, and the guard member 402 returns to the initial position (evacuation position) of FIG. 12 by a restoring force of the biasing member 425.

Thus, when the sheet material P is cut by the cutting blade 413, the opposing member 403 regulates the sheet material P from moving in the direction in which the sheet material P is pushed by the cutting blade 413, and the cutting by the cutting blade 413 can be easily performed.

In the above-described printing apparatus, the printing unit is described with a configuration of performing printing with the discharger to discharge liquid. Alternatively, for example, printing may be performed by an electrophotographic method. In each of the above-described embodiments, the sheet material cutting device is described with the example of being disposed downstream of the coater of the coating device in the conveyance direction of a sheet material. Alternatively, the sheet material cutting device can also be disposed upstream of the coater. Further, in each of the above-described embodiments, the sheet material cutting device is described with the example of being disposed in the coating device. Alternatively, for example, the sheet material cutting device can also be disposed in a device other than the coating device such as in a drying device.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A sheet material cutting device comprising:

a cutting blade displaceably disposed and configured to cut a web-shaped sheet material;

a guard member configured to face the sheet material, wherein the guard member has a slit through which the cutting blade is configured to pass when the cutting blade is displaced to a cutting position;

an arm member, the cutting blade being attached to a first end of the arm member; and a contact member attached to a second end of the arm member and configured to contact the sheet material.

2. The sheet material cutting device according to claim 1, wherein the guard member is displaceably disposed in a same direction as the cutting blade.

3. The sheet material cutting device according to claim 2, wherein the cutting blade and the guard member are configured to be displaced together when at least a portion of the cutting blade passes through the slit of the guard member and is displaced to a predetermined position.

4. The sheet material cutting device according to claim 2, wherein the cutting blade and the guard member are configured to return to an evacuation position after the cutting blade cuts the sheet material.

5. The sheet material cutting device according to claim 1, further comprising an opposing member disposed opposite the guard member across the sheet material.

6. The sheet material cutting device according to claim 5, wherein the opposing member has a slit through which the cutting blade is configured to enter.

7. The sheet material cutting device according to claim 1, wherein:

the arm member is rotatably supported, and the second end of the arm member is opposite the first end.

8. A coating device comprising:

a coater configured to coat a coating liquid on the sheet material; and the sheet material cutting device according to claim 1.

9. A printing apparatus comprising the coating device according to claim 8.

10. A printing apparatus comprising the sheet material cutting device according to claim 1.

* * * * *